United States Patent [19]

Toomay

[11] 4,059,213

[45] Nov. 22, 1977

[54] CLUTCHLESS PAPER ADVANCE MECHANISM

[75] Inventor: Timothy L. Toomay, Palo Alto, Calif.

[73] Assignee: Hewlett-Packard Company, Palo Alto, Calif.

[21] Appl. No.: 693,565

[22] Filed: June 7, 1976

Related U.S. Application Data

[63] Continuation of Ser. No. 515,729, Oct. 17, 1974, abandoned.

[51] Int. Cl.[2] ..... B65H 17/44

[52] U.S. Cl. ..... 226/151; 226/165; 226/167

[58] Field of Search ..... 226/165, 166, 167, 162, 226/146, 147, 151; 294/102

[56] References Cited

U.S. PATENT DOCUMENTS

| | | | |
|---|---|---|---|
| 2,291,065 | 7/1942 | Walker | 226/166 X |
| 2,586,536 | 2/1952 | Haller | 226/162 X |
| 2,696,380 | 12/1954 | Adams | 226/165 |
| 2,810,573 | 10/1957 | Nadel | 226/151 |
| 2,953,290 | 9/1960 | Kostenko | 226/151 |
| 3,556,376 | 1/1971 | Offterdinger | 226/165 X |

FOREIGN PATENT DOCUMENTS

| | | | |
|---|---|---|---|
| 1,013,620 | 8/1957 | Germany | 226/165 |

*Primary Examiner*—Allen N. Knowles
*Attorney, Agent, or Firm*—F. D. LaRiviere

[57] ABSTRACT

The paper advance mechanism disclosed herein comprises two essentially identical paper-engaging devices, one fixed, one driven, which cooperate to incrementally advance the paper in a hand-held printing calculator. Each device includes a tapered cavity enclosing a roller which engages the paper as it passes therethrough. The position of the roller in the cavity determines whether that device slidably or non-slidably engages the paper and the position of the roller is determined by the movement of the paper itself. The paper-engaging devices alternately non-slidably engage the paper; when the driven device moves in one direction, it non-slidably engages and thus advances the paper as it moves, and the paper slides through the fixed device; when the driven device reverses direction, it slidably engages the paper as it returns to the start of its travel and the fixed device non-slidably engages the paper to hold the advanced paper in position.

10 Claims, 9 Drawing Figures

CLUTCHLESS PAPER ADVANCE MECHANISM

CROSS REFERENCE TO RELATED APPLICATION

This is a continuation of application Ser. No. 515,729, filed Oct. 17, 1974, now abandoned.

BACKGROUND OF THE INVENTION

Prior art paper advance mechanisms usually include a plurality of friction rollers driven by a stepping motor or solenoid. One-way clutches or ratchets are also often used. Typically, the rollers are arranged to receive the paper in pinching engagement and incremental movement of the paper is then provided by the stepping motor or solenoid via the one-way clutches or ratchets. Such systems are simply too large and expensive to incorporate into a hand-held calculator.

SUMMARY OF THE INVENTION

The paper-engaging devices (hereinafter referred to as grips) according to one embodiment of the present invention permit the paper to slide through them in one direction but not in the reverse direction. This one-direction gripping action is achieved by a free-rolling cylinder (hereinafter referred to as a roller) in a tapered cavity, constantly engaging the paper. No separate clutch mechanism is required for release once gripped.

The roller rolls in response to movement of the paper. When the cylinder is at the widest portion of the cavity, there is ample clearance for the paper to slide through without prohibitive interference with the roller. As the roller rolls toward the narrowest portion of the cavity, it begins to substantially interfere with the paper. The farther toward the narrowest end of the cavity the cylinder rolls, the greater the interference (i.e. frictional engagement) with the paper until there is non-slidable engagement. By reversing the direction of the movement of the paper relative to the paper grip, the roller is caused to roll toward the widest portion of the cavity and the non-slidable engagement is released.

Another embodiment of a grip constructed according to the present invention actually provides for the paper to slide through it in the reverse direction. If substantial drag force is applied to the paper as, for example, if the paper is held while the advance mechanism operates or if the user pulls the paper out of the mechanism in the reverse direction, the paper will not be torn and the advance will not be jammed with scraps of paper.

The preferred embodiment of the present invention employs two of the above-described paper grips which alternately, non-slidably engage the paper being advanced. One of the paper grips is driven and the other is fixed. When the driven grip moves in one direction, it non-slidably engages and thus advances the paper as it moves, while the paper freely slides through the fixed grip. When the driven grip reverses direction, it slidably engages the paper as it returns to the start of its travel in response to non-slidable engagement of the paper by the fixed grip which effectively holds the advanced paper in position. Simultaneous non-slidable engagement by one embodiment of the two grips is precluded by the fact that the movement of the paper relative to each grip is in opposite directions at all times. Simultaneous non-slidable engagement by another embodiment of the two grips is permitted when the drag force on the paper is substantial enough to overcome the gripping force developed by the grips.

DESCRIPTION OF THE PREFERRED EMBODIMENT

Figure 1:
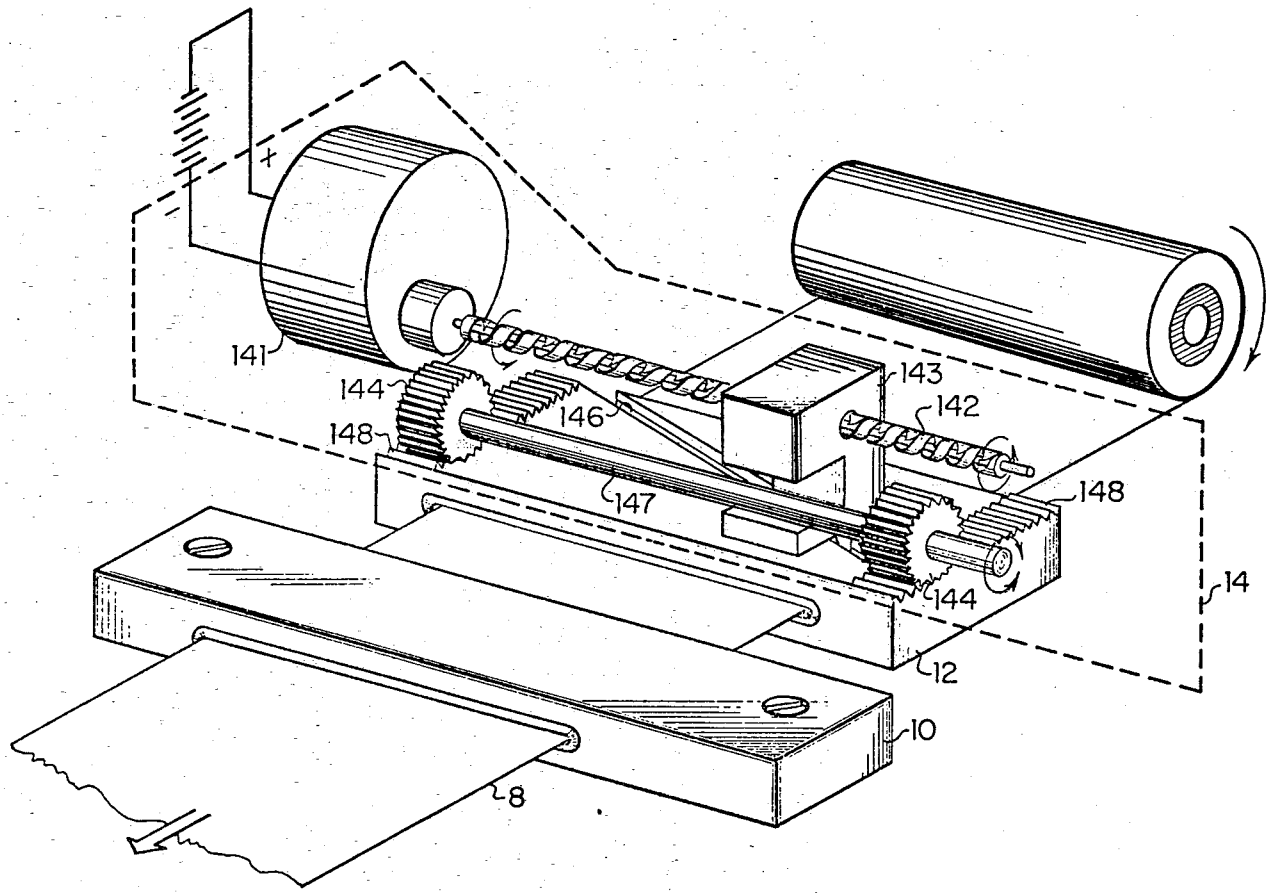
FIG. 1 is a perspective view of a clutchless paper advance mechanism constructed according to the preferred embodiment of this invention.

Referring to FIG. 1, the paper advance mechanism of this invention comprises fixed paper grip 10, movable paper grip 12 driven by drive system 14 for moving paper 8 in the direction indicated by the arrow. Each of the paper grips is constructed as shown in FIG. 2.

Figure 2:
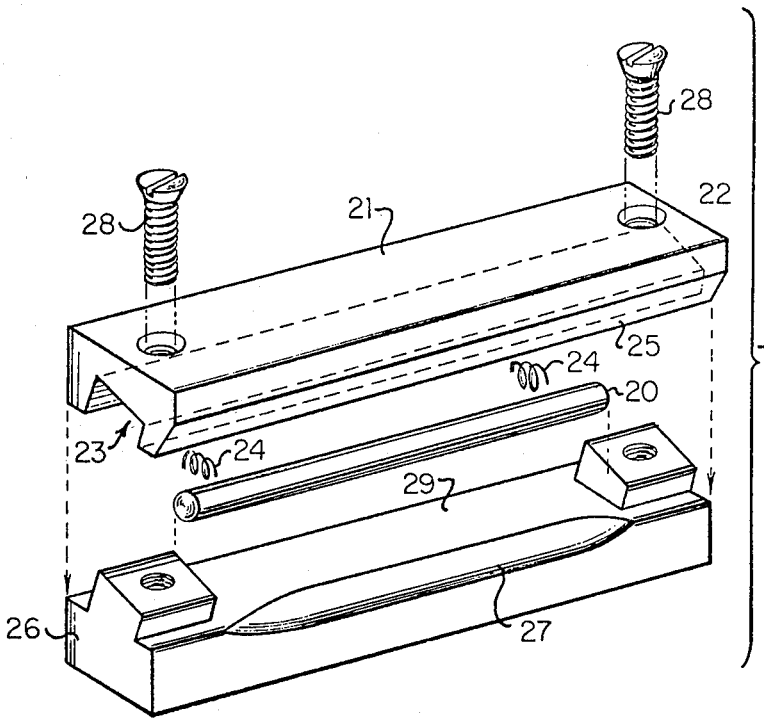
FIG. 2 is a perspective, disassembled view of one embodiment of a paper-engaging device for the paper advance mechanism of FIG. 1.

Referring now to FIG. 2, each paper grip shown in FIG. 1 includes roller 20, retainer 22 having a tapered cavity 23 and bevelled face 25, springs 24, and receiver 26 having bevelled face 27 held together by screws 28. The grip engages the paper between bevelled faces 25 and 27, and operates on the paper as it passes between roller 20 and receiver surface 29. While each grip is designed to accommodate paper of 1.5 inch width and 0.0028 inch thickness for use in a hand-held, moving-head printing calculator, the usefulness of this invention is not limited to paper of those dimensions or to calculator applications.

Figure 3A:
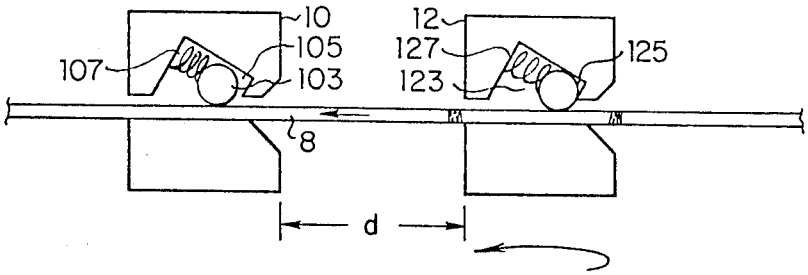
FIG. 3*a* is a schematic view of the paper advance mechanism of FIG. 1 showing the home position of the movable grip.
Figure 3B:
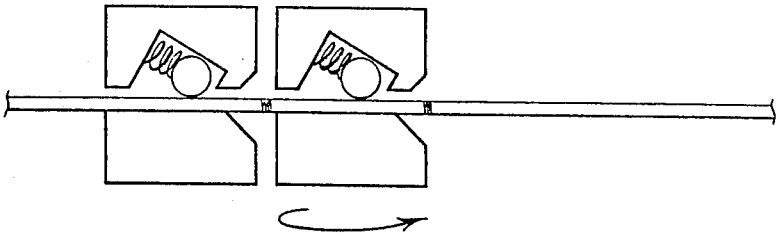
FIG. 3*b* is a schematic view of the paper advance mechanism of FIG. 1 showing the advance position of the movable grip.
Figure 3C:
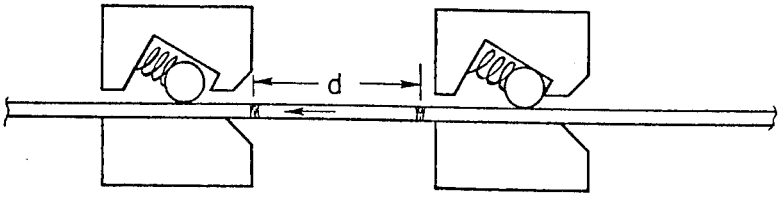
FIG. 3*c* is a schematic view of the paper advance mechanism of FIG. 1 showing the movable grip return to home position after the paper has been advanced through one cycle.

As indicated in FIG. 1, two of the paper grips shown in FIG. 2 are placed in series in the path of the paper to be advanced. Referring now to FIGS. 3*a*, 3*b* and 3*c*, paper grip 10 is fixed and movable grip 12 reciprocates in the direction of paper advancement from home position as shown in FIG. 3*a* to advance position as shown in FIG. 3*b* and back to home position as shown in FIG. 3*c*. When movable grip 12 begins to move, paper 8 tends to remain in place and roller 123 is rolled toward the narrow portion 125 of the tapered cavity, until it is deflected toward receiver surface 29 with sufficient force to non-slidably engage the paper. The paper is thus forced to move with grip 12 to the advance position. As the paper moves, roller 103 is rolled toward the wide end 107 of the tapered cavity in grip 10 and continues in rolling engagement with paper 8 as it slides therethrough.

When movable grip 12 begins its return stroke to home position, paper 8 is still pinched therein and it tends to drag the paper back. However, with this movement of the paper, roller 103 is rolled toward the narrow end 105 of the tapered cavity in grip 10 until it is deflected toward receiver surface 29 with sufficient force to non-slidably engage the paper. Since paper 8 is now halted, roller 123 is rolled toward the wide end 127 of the tapered cavity in grip 12 by the relative movement of the paper therewith and continues in rolling engagement with paper 8 during the remainder of the return stroke. Thus paper 8 has advanced nearly the same distance, *d*, through which movable grip 12 has traveled from home to advance position. If the cycle described above and shown in FIGS. 3*a*, 3*b* and 3*c* is repeated, the paper advances in step-like fashion well-suited, for example, for use in a moving-head printer. The paper grip of the present invention provides a one-way clutch effect in response to relative movement of the paper and not by separate clutch means.

Referring again to FIG. 2, springs 24 tend to force roller 20 to the narrow end of tapered cavity 23 and the surface of roller 20 is prepared to enhance the frictional force between it and the paper. This configuration assures that backlash, i.e. the distance travelled by the movable grip minus the net distance through which the paper travels, is minimized and essentially the same for each cycle. The amount of backlash is directly proportional to the force exerted on the paper by the springs via the roller. However, the drag on the movable grip, or on the paper as it passes through the fixed grip, is also directly proportional to that force. Therefore, to reduce drag, some backlash must be tolerated.

Figure 4:
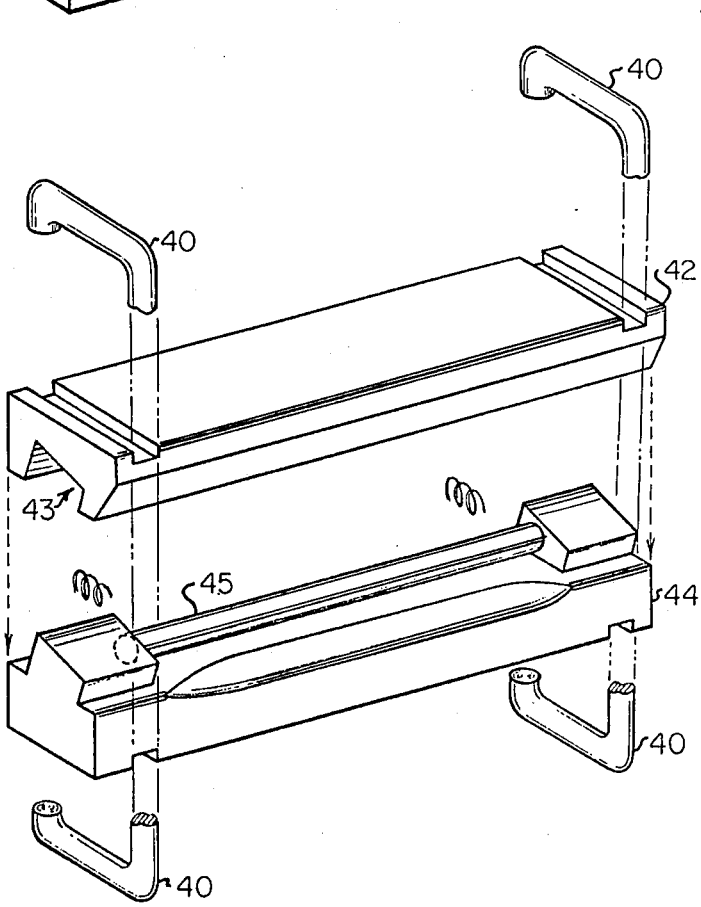
FIG. 4 is a perspective, disassembled view of another embodiment of a paper-engaging device for the paper advance mechanism of FIG. 1.

FIG. 4 shows another embodiment of the paper grip shown in FIG. 2. Clips 40, which are used instead of screws 28, clamps retainer 42 to receiver 44. Tapered cavity 43 and roller 45 are substantially the same as tapered cavity 23 and roller 20, respectively. In normal use, the operation of this embodiment is, in all respects, essentially the same as the embodiment shown in FIG. 2. However, the embodiment of FIG. 2 precludes slidable engagement with the paper in both directions of relative movement thereof.

Figure 5A:
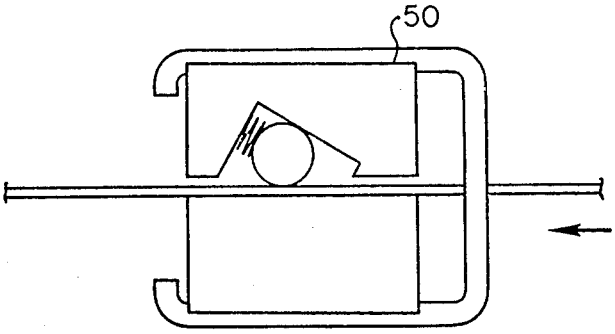
FIG. 5*a* is a schematic view showing sliding operation of the paper-engaging device of FIG. 4.
Figure 5B:
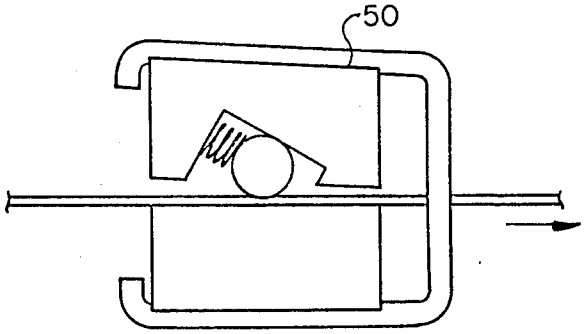
FIG. 5*b* is a schematic view showing normal non-sliding operation of the paper-engaging device of FIG. 4.
Figure 5C:
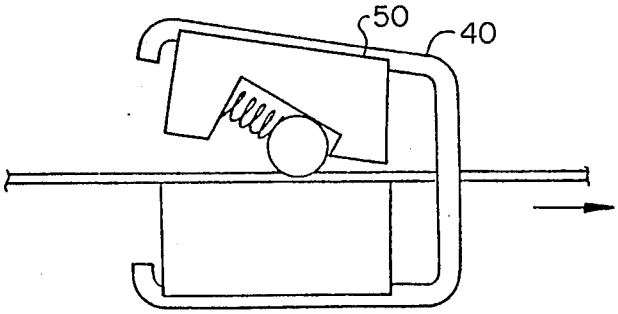
FIG. 5*c* is a schematic view showing non-sliding operation of the paper-engaging device of FIG. 4 when excessive drag force is applied to the paper.

The embodiment of FIG. 4 permits the paper to slide in the direction which normally activates the grip into non-slidable engagement therewith if the force on the paper is sufficient to exceed the clamping force of clamps 40. Referring to FIG. 5*a*, as the paper moves in the direction indicated by the arrow, it is slidably engaged by fixed grip 50. When the paper moves in the reverse direction as shown in FIG. 5*b*, it is non-slidably engaged by grip 50. If the force moving the paper exceeds the clamping force of clamps 40, then, as the clamps yield, the paper will slide in direction indicated by the arrow in FIG. 5*c*. If the clamping force of clamps 40 is less than the force required to tear the paper, the paper will not be torn if the paper binds during operation of the advance mechanism or if the user pulls the paper out of the mechanism backwards.

Referring again to FIG. 1 drive system 14 includes electric motor 141 which turns double helix cam 142. Print head 143 includes a follower which rides in the helical groove of cam 142. As cam 142 turns, the print head is repetitively driven to one end thereof, then reversed and driven to the other end and reversed again. This motion, transverse to the direction of paper advance, is translated 90° by means of rib 145 protruding from print head 143 into groove 146 which is cut into surface 21 of retainer 22 of paper grip 12. Thus, grip 12 either advances the paper or returns to home position in response to movement of print head 143. More particularly, the motion of print head 143 when printing a line of characters, is translated into returning the movable grip 12 to home position. Conversely, the motion of print head 143 as it returns to the beginning of the next line of characters to be printed is translated into driving grip 12 to the advance position.

The force required to move the grip 12 is equal to the drag of the paper on movable grip 12. That force may be represented as a point force near the center of movable grip 12 opposing the direction of motion. As print head 143 moves back and forth along groove 146, the point of application of the force also moves back and forth along the groove. When print head 143 moves toward one end of groove 146, the force it exerts on grip 12 and the opposing drag result in a moment which tends to rotate grip 12 in a plane parallel to the paper. Thus, if not properly guided, grip 12 does not remain parallel to fixed grip 10 and will tend to wobble as it moves. This wobbling is undesirable since the paper is not advanced smoothly or uniformly.

Any method or apparatus for avoiding or controlling wobble may be used. The preferred embodiment of the present invention employs a rack and pinion configuration. Two pinion gears 144, connected by shaft 147, mate with racks 148 on each end of grip 12. The racks may be a continuous part of the retainer 22 or they may be separately mounted thereon. As one end of grip 12 moves, the rack on that end drives a pinion. As that pinion rotates, the rotation is transmitted through shaft 147 to the other pinion which is engaged with the rack on the other end of grip 12. Since both ends of grip 12 are now driven at the same rate, uniform line-by-line advance of the paper is assured.

I claim:

1. Apparatus for advancing paper along a guide path, said apparatus comprising:

first paper-engaging means, non-rotatably mounted for translation along the guide path including a roller, said roller being responsive to movement of the means in a first direction relative to the paper for non-slidably gripping the paper and for advancing the paper in the first direction, and to movement of the means in a second direction relative to the paper for rollably engaging the paper;

drive means coupled to the first paper-engaging device for moving that device in the first and second directions; and second paper-engaging means non-rotatably and fixedly mounted in the guide path and including a roller, said roller being responsive to movement of the paper in the first direction for rollably engaging the paper, and to movement of the paper in the second direction for non-slidably gripping the paper and for preventing movement of the paper in the second direction when the first paper-engaging means is moving in that direction;

said second paper-engaging means including means for releasing its non-slidable grip with the paper when the force tending to cause the paper to move in the second direction exceeds a first value.

2. An apparatus as in claim 1 wherein:

the roller is housed in a cavity having wide and narrow portions and deflecting means for urging the roller into the narrow portion of the cavity, said paper being in substantially constant engagement with the roller when passing through the cavity; and said roller is effective for non-slidably gripping the paper in response to the relative movement of the paper toward the narrow portion of the cavity and for rollably engaging the paper in response to the relative movement of the paper toward the wide portion of the cavity.

3. An apparatus as in claim 1 wherein:

the first paper-engaging means is effective for advancing the paper along the guide path in the first direction by frictional engagement of the roller therewith;

the second paper-engaging means is effective for preventing movement of the paper in the guide path by frictional engagement of the roller therewith when the first paper-engaging means is moving in the second direction.

4. An apparatus as in claim 1 wherein the first value is less than the force required to tear the paper.

5. An apparatus as in claim 1 wherein the means for releasing the non-slidable grip of the first and second paper-engaging means is effective for releasing the non-slidable grip of the roller with the paper when the force causing the relative movement of the roller toward the narrow end of the cavity exceeds a first value.

6. An apparatus as in claim 1 wherein:

the first and second paper-engaging means each include a retainer and a receiver; and the means for releasing the first and second paper-engaging means non-slidable grip of the paper are sets of clamps for holding the retainer and receiver of each paper-engaging means together, said clamps yielding to allow partial separation of the retainer and receiver when the force causing non-slidable gripping of the paper by the rollers in the paper-engaging means exceeds the first value.

7. An apparatus as in claim 6 wherein the drive means is coupled to the first paper-engaging means at points corresponding to both ends of the roller so that the axis of the roller is perpendicular to its movement relative to the paper.

8. An apparatus as in claim 1 wherein said drive means further includes orientation means for maintaining the orientation of the first paper-engaging means parallel to the orientation of the second paper-engaging means in the guide path while moving in the first direction.

9. An apparatus as in claim 8 wherein said orientation means is a rack and pinion gear.

10. An apparatus as in claim 8 wherein said orientation means maintains orientation of the first paper-engaging means parallel to the orientation of the second paper-engaging means in the guide path while moving in the second direction.

* * * * *